US006547081B1

(12) United States Patent
Kaminski

(10) Patent No.: US 6,547,081 B1
(45) Date of Patent: Apr. 15, 2003

(54) SLIDE ASSEMBLY FOR USE IN A RACK ASSEMBLY

(75) Inventor: Joseph W. Kaminski, Campbell, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/014,968

(22) Filed: Dec. 10, 2001

(51) Int. Cl.[7] ..... A47B 57/00
(52) U.S. Cl. ..... 211/26
(58) Field of Search ..... 211/175, 26, 151; 312/223.2, 334.1, 334.4, 334.8; 361/683, 829

(56) References Cited

U.S. PATENT DOCUMENTS 3,092,429 A * 6/1963 Barnes
3,133,768 A * 5/1964 Klakovich
5,460,441 A * 10/1995 Hastings et al. ..... 312/223.2 X
5,571,256 A * 11/1996 Good et al. ..... 211/26
5,833,337 A * 11/1998 Kofstad ..... 312/334.4 X
5,941,621 A * 8/1999 Boulay et al. ..... 312/334.4
6,123,203 A * 9/2000 Gibbons ..... 211/26
6,209,979 B1 * 4/2001 Fall et al. ..... 312/334.8 X
6,230,903 B1 * 5/2001 Abbott ..... 211/26
6,305,556 B1 * 10/2001 Mayer ..... 211/26
6,398,041 B1 * 6/2002 Abbott ..... 211/26

* cited by examiner

*Primary Examiner*—Robert W Gibson

(57) ABSTRACT

A high load capacity, low profile, low friction slide assembly for use in a rack assembly. In one embodiment, the present invention comprises a first longitudinal member having a central portion, a first upwardly extending portion on one side and a second upwardly extending portion on the other side and a second longitudinal member having a central portion, a first downwardly extending portion on one side and a second downwardly extending portion on the other side. The second longitudinal member is slidably engaged with the first longitudinal member such that the second longitudinal member can slide lengthwise with respect to the first longitudinal member. The first downwardly extending portion engages the first longitudinal member proximate the juncture between the first upwardly extending portion and the central portion of the first longitudinal member and the second downwardly extending portion engages the first longitudinal member proximate the juncture between the second upwardly extending portion and the central portion of the first longitudinal member.

23 Claims, 6 Drawing Sheets

SLIDE ASSEMBLY FOR USE IN A RACK ASSEMBLY

FIELD OF INVENTION

The present invention relates to the field of rack mounts. Specifically, the present invention relates to a high load capacity, low profile, low friction slide assembly for use in a rack mount.

BACKGROUND OF THE INVENTION

In modern computing, racks are often used for storing chassis for receiving computer components. A rack is a frame or cabinet into which the chassis are mounted. Many types of electronics and computing devices come in rack mounted chassis, including servers, test instruments, telecommunications components and tape drives. Rack cabinets typically have a standard panel width of 19", restricting a chassis width to 19". Likewise, the height of a rack-mounted device is specified in a unit (U) measure. 1-U is 1.75" from top to bottom.

Chassis can be bolted into the rack or placed on shelves located within the rack. However, as it is often desirable to have easy access to all sides of each chassis, slide assemblies may be used to permit this access. Slide assemblies operate such that a chassis can be extended from an unextended position to a fully extended position while still being connected to the rack.

There is limited space between chassis equipment and the inner side of rack assembly. Typically, the width of this gap is 12 mm. However, for some rack assemblies, the width of this gap is 10 mm. Currently, in racks with a gap of 10 mm, commercially available slide assemblies designed for a gap of 12 mm cannot be utilized for mounting chassis.

Commercially available slide assemblies also are limited in their load capacity when extended. Typical slide assemblies are limited to 15 to 18 pounds before deformation occurs. Thus, when a chassis is heavier than 18 pounds, two or more pairs of slide assemblies are required, increasing the cost of the installation as well as increasing installation time.

Also, commercially available slides often have a relatively high friction caused by the surface to surface contact of the inner slide to the outer sleeve. Typically, a force equivalent to 75–80% of the chassis load is required to extend the slide assemblies.

Accordingly, a need exists for a low profile slide assembly that can be used irrespective of the gap between the chassis equipment and the inner side of rack assembly. Furthermore, a need exists for a slide assembly that accomplishes the above need and can carry a higher load when fully extended. A need also exists for a slide assembly that accomplishes the above needs and has a low friction component, requiring less force to extend the slide assembly.

DISCLOSURE OF THE INVENTION

The method and apparatus of the present invention provides a low profile slide assembly that can be used irrespective of the gap between the chassis equipment and the inner side of rack assembly. Moreover, the method and apparatus of the present invention also provides a slide assembly that can carry a higher load when fully extended. Furthermore, the method and apparatus of the present invention also provides a slide assembly that has a low friction component, requiring less force to extend the slide assembly.

A high load capacity, low profile, low friction slide assembly for use in a rack assembly is presented. In one embodiment, the present invention comprises a first longitudinal member and a second longitudinal member. The second longitudinal member is slidably engaged with the first longitudinal member such that the second longitudinal member can slide lengthwise with respect to the first longitudinal member.

In one embodiment, the first longitudinal member has a central portion, a first upwardly extending portion on one side and a second upwardly extending portion on the other side and the second longitudinal member has a central portion, a first downwardly extending portion on one side and a second downwardly extending portion on the other side.

In one embodiment, the first downwardly extending portion engages the first longitudinal member proximate the juncture between the first upwardly extending portion and the central portion of the first longitudinal member and the second downwardly extending portion engages the first longitudinal member proximate the juncture between the second upwardly extending portion and the central portion of the first longitudinal member.

In one embodiment, the present invention also comprises a third longitudinal member coupled to a rack, wherein the third longitudinal member is slidably engaged with the first longitudinal member such that the first longitudinal member can slide lengthwise with respect to the third longitudinal member.

In one embodiment, the present invention further comprises a chassis for receiving a computer-related component, wherein the chassis is coupled to the second longitudinal member such that the chassis can be extended from an unextended position to a fully extended position.

Other features and advantages of the invention will become apparent from the following detailed description, taken in conjunction with the accompanying drawings, illustrating by way of example the principles of the invention.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODES FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and the scope of the invention as defined by the appended claims. Furthermore, in the following detailed description of the present invention, numerous specific details are set forth in order to provide a thorough understanding of the present invention. However, it will be apparent to one skilled in the art that the present invention may be practiced without these specific details. In other instances, well-known methods, procedures, components, structures and devices have not been described in detail so as to avoid unnecessarily obscuring aspects of the present invention.

Figure 1B:
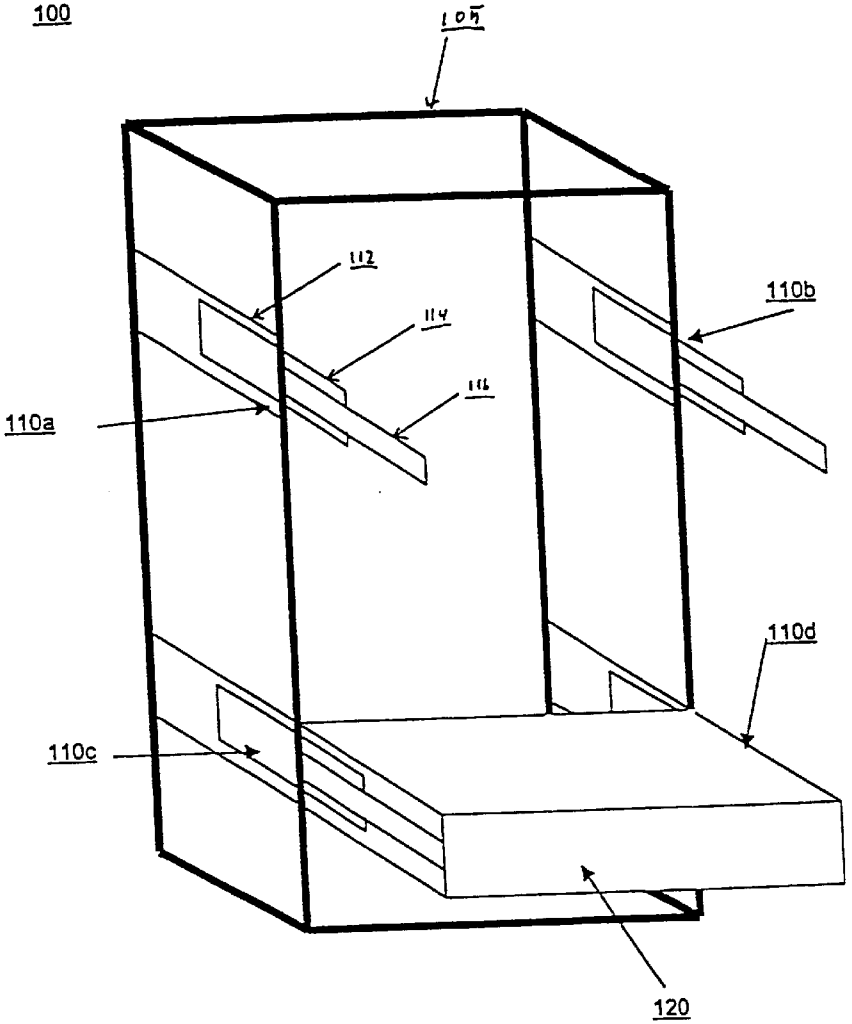
FIG. 1B is a perspective view of a rack assembly that includes two pairs of slide assemblies in a fully extended position in accordance with one embodiment of the present invention.
Figure 1A:
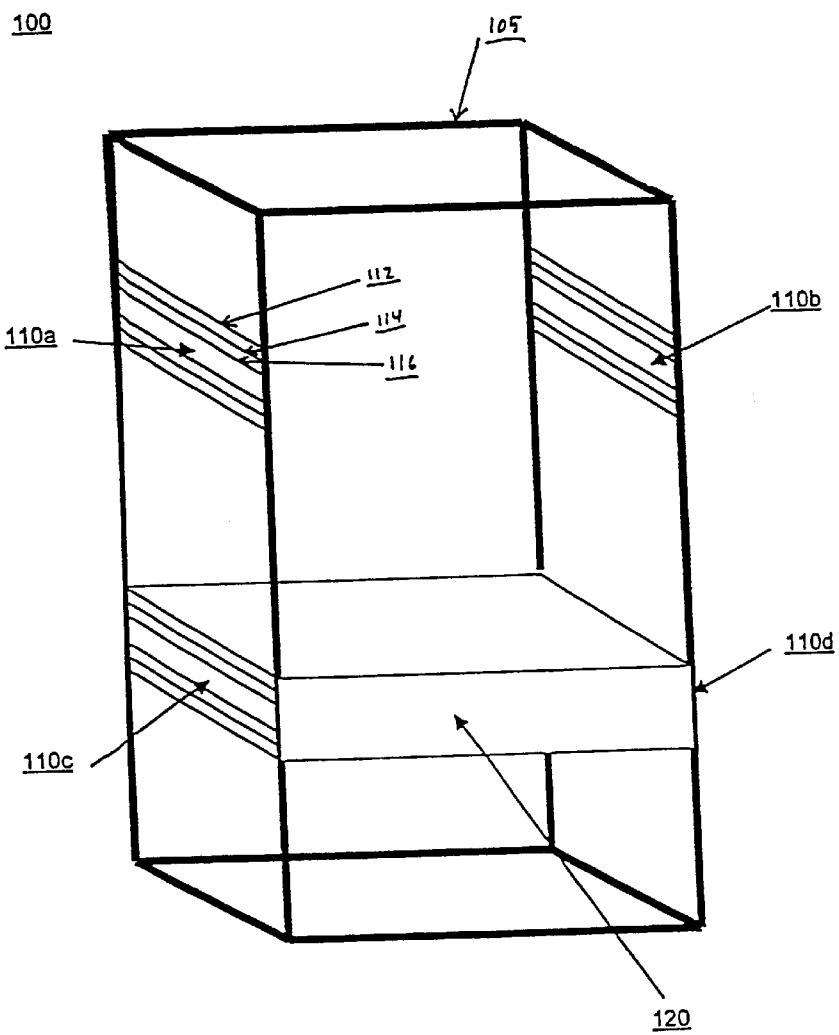
FIG. 1A is a perspective view of a rack assembly that includes two pairs of slide assemblies in an unextended position in accordance with one embodiment of the present invention.

FIG. 1A is a perspective view of a rack assembly 100 that includes two pairs of slide assemblies in an unextended position in accordance with one embodiment of the present invention. Rack assembly 100 comprises rack 105, slide assemblies 110*a–d* couple to rack 105, and chassis 120 coupled to slide assemblies 110*c* and 110*d*. Chassis 120 is for receiving a computer-related component. It should be appreciated that slide assemblies 110*c* and 110*d* operate in conjunction for supporting chassis 120.

It should also be appreciated that slide assemblies 110*c* and 110*d* are mounted to rack 105 in the gap between rack 105 and chassis 120. This gap may vary in size, but is typically 10 mm or 12 mm. The slide assembly of the present invention has a low profile such that it can fit in smaller sized gaps, but may be widened to fit within larger sized gaps.

Slide assemblies 110*a–d* comprise outer slide component 112, intermediate slide component 114, and inner slide component 116. In one embodiment, outer slide component 112 are slidably engaged with intermediate slide component 114 such that intermediate slide component 114 can slide lengthwise with respect to outer slide component 112. Similarly, inner slide component 116 slidably engages with intermediate slide component 114 such that inner slide component 116 can slide lengthwise with respect to intermediate slide component 114.

As illustrated in FIG. 1A, slide assemblies 110*a–d* are in an unextended position. Slide assemblies 110*a–d* are operable such that they can be extended out from an unextended position to a fully extended position. Moreover, chassis 120 is also in an unextended position, due to the positioning of slide assemblies 110*c* and 110*d*.

FIG. 1B is a perspective view of a rack assembly 100 that includes two pairs of slide assemblies in a fully extended position in accordance with one embodiment of the present invention. As illustrated, slide assemblies 110*a–d* are in a fully extended position. Furthermore, chassis 120 is also in a fully extended position, due to the positioning of slide assemblies 110*c* and 110*d*.

Figure 2:
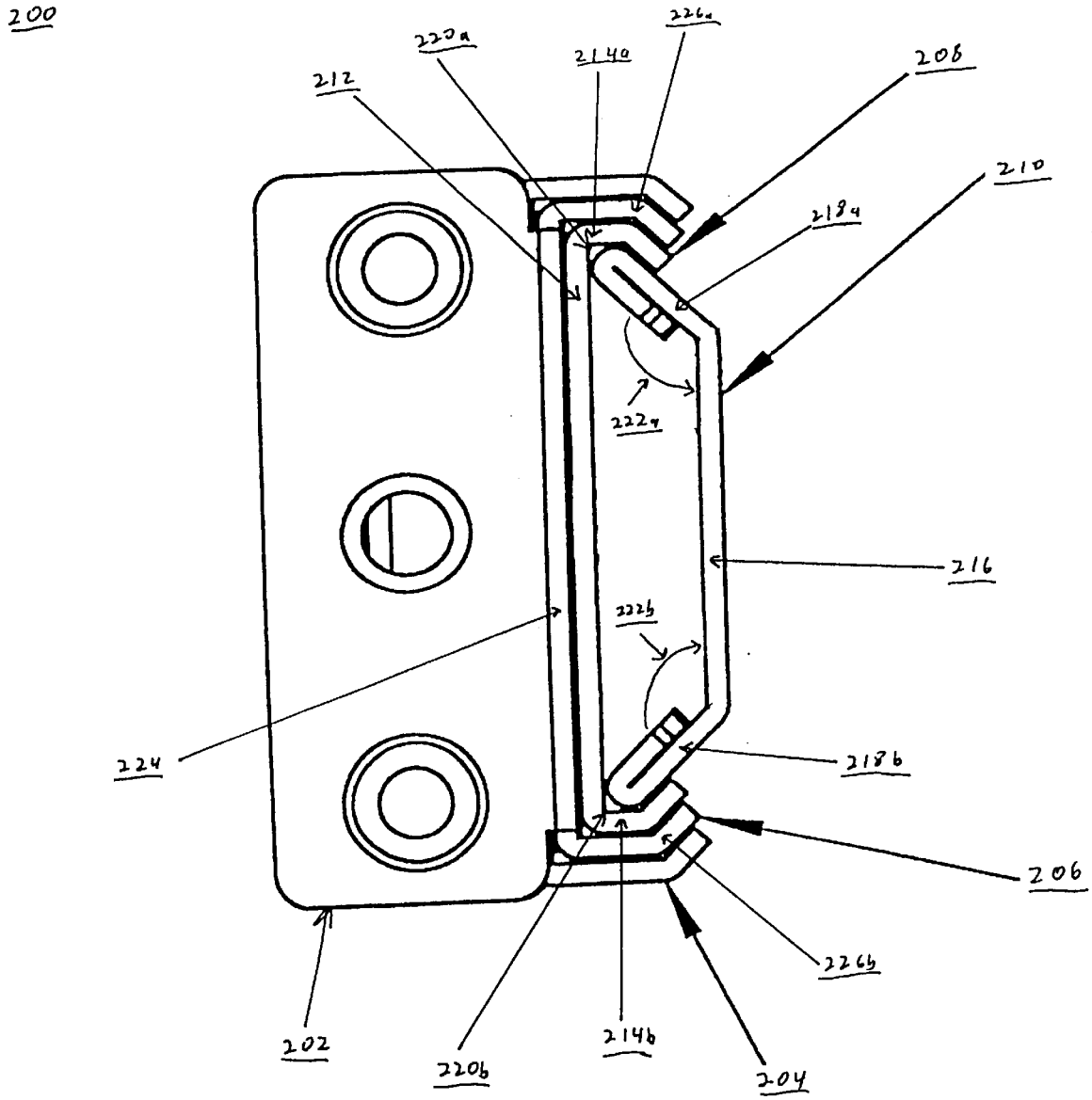
FIG. 2 shows a front view of a slide assembly in accordance with one embodiment of the present invention.

FIG. 2 shows a cross-sectional view of a slide assembly 200 in accordance with one embodiment of the present invention. Slide assembly 200 comprises mounting flange 202, first outer slide component 204, second outer slide component 206, intermediate slide component 208 (e.g., intermediate slide component 114 of FIGS. 1A and 1B) and inner slide component 210 (e.g., inner slide component 116 of FIGS. 1A and 1B).

Mounting flange 202 is for use in mounting slide assembly 200 to a rack (e.g., rack 105 of FIGS. 1A and 1B). First outer slide component 204 and second outer slide component 206 are for use in adjusting the length of slide assembly 200. As racks vary in depth, first outer slide component 204 and second outer slide component 206 operating in conjunction (e.g., outer slide component 112 of FIGS. 1A and 1B) provide a slide assembly for use in any rack, regardless of the depth. Second outer slide component 206 has a central portion 224, a first upwardly extending portion 226*a* on one side and a second upwardly extending portion 226*b* on the other side. It should be appreciated that first outer slide component 204 and second outer slide component 206 are statically connected such that they operate as one outer slide component.

In one embodiment, first outer slide component 204 and second outer slide component 206 are coupled to a rack and are slidably engaged with intermediate slide component 208 such that intermediate slide component 208 can slide lengthwise with respect to first outer slide component 204 and second outer slide component 206.

Intermediate slide component 208 has a central portion 212, a first upwardly extending portion 214*a* on one side and a second upwardly extending portion 214*b* on the other side. Inner slide component 210 has a central portion 216, a first downwardly extending portion 218*a* on one side and a second downwardly extending portion 218*b* on the other side.

Inner slide component 210 slidably engages with intermediate slide component 208 such that inner slide component 210 can slide lengthwise with respect to intermediate slide component 208.

In one embodiment, first downwardly extending portion 218*a* engages intermediate slide component 208 proximate juncture 220*a* between first upwardly extending portion 214*a* and central portion 212 and second downwardly extending portion 218*b* engages intermediate slide component 208 proximate juncture 220*b* between first upwardly extending portion 214*b* and central portion 212. In another embodiment, first downwardly extending portion 218*a* engages intermediate slide component 208 at juncture 220*a* and second downwardly extending portion 218*b* engages intermediate slide component 208 at juncture 220*b*.

In one embodiment, first downwardly extending portion 218*a* and second downwardly extending portion 218*b* extend symmetrically from central portion 216. In another embodiment, first downwardly extending portion 218*a* and central portion 216 form a cross-sectional angle 222*a* of substantially 135 degrees and second downwardly extending portion 218*b* and central portion 216 form a cross-sectional angle 222*b* of substantially 135 degrees.

In one embodiment, inner slide component 210 is configured for mounting to a chassis for receiving a computer-related component (e.g., chassis 120 of FIGS. 1A and 1B). The chassis is coupled to inner slide component 210 such that the chassis can be extended from an unextended position to a fully extended position.

Figure 3:
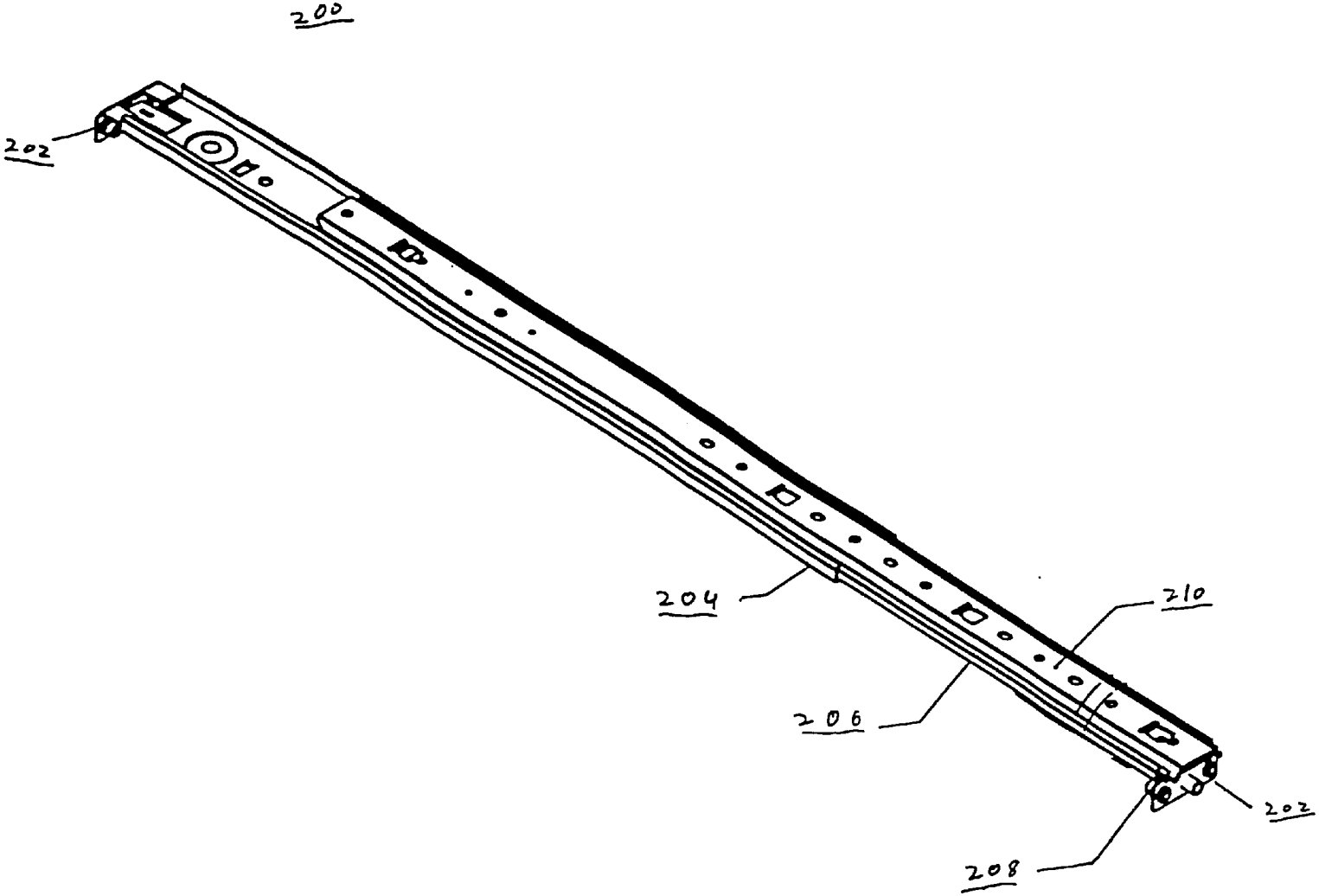
FIG. 3 shows a perspective view of a slide assembly in accordance with one embodiment of the present invention.

FIG. 3 shows a perspective view of a slide assembly 200 in accordance with one embodiment of the present invention. As illustrated, first outer slide component 204 and second outer slide component 206 operate in conjunction and are fixed relative to each other for mounting to a rack assembly. Slide assembly 200 is mounted to a rack assembly by mounting flanges 202.

First outer slide component 204 and second outer slide component 206 are slidably engaged with intermediate slide component 208 such that intermediate slide component 208 can slide lengthwise with respect to first outer slide component 204 and second outer slide component 206. Likewise, inner slide component 210 slidably engages with intermediate slide component 208 such that inner slide component 210 can slide lengthwise with respect to intermediate slide component 208.

Figure 4B:
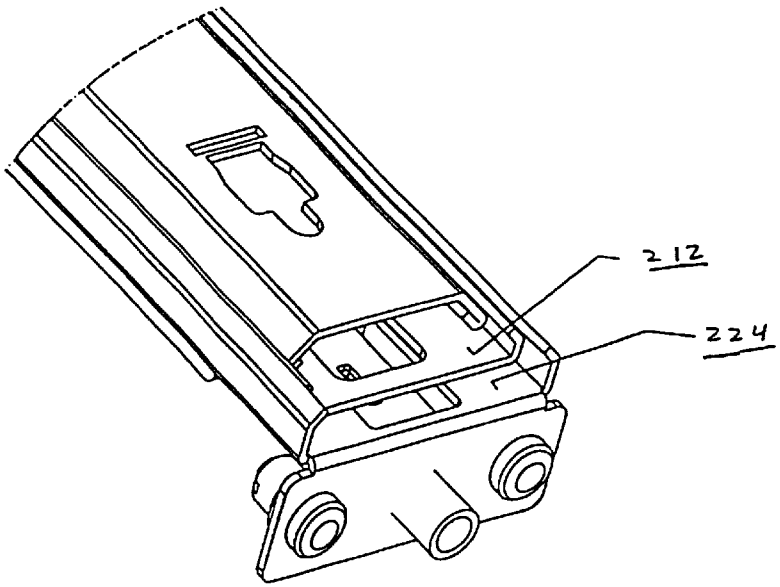
FIG. 4B illustrates an expanded view of a portion of the slide assembly of FIG. 3 in which the intermediate slide and the inner slide are slide inward with respect to the outer slide.
Figure 4A:
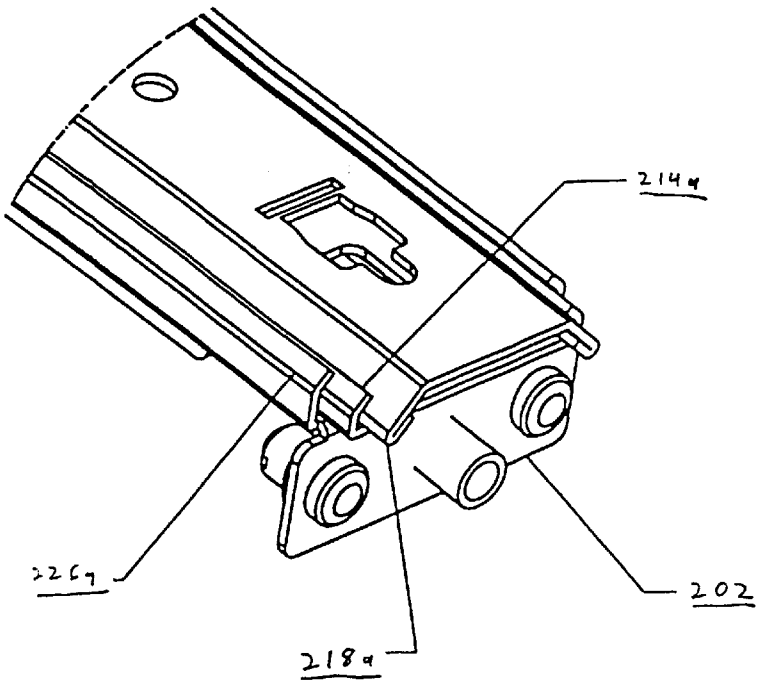
FIG. 4A illustrates an expanded view of a portion of the slide assembly of FIG. 3 in which the intermediate slide and the inner slide are slide outward with respect to the outer slide.

FIG. 4A illustrates an expanded view of a portion of the slide assembly of FIG. 3 in which the intermediate slide and the inner slide are slide outward with respect to the outer slide. Similarly, FIG. 4B illustrates an expanded view of a portion of the slide assembly of FIG. 3 in which the intermediate slide and the inner slide are slide inward with respect to the outer slide. In one embodiment, first outer slide component 204, second outer slide component 206, intermediate slide component 208 and inner slide component 210 have a trapezoidal profile that is symmetrical on both side of slide assembly 200.

In one embodiment, first upwardly extending portion 214*a* and central portion 212 form a wedge type bend of substantially 45 degrees. Likewise, first upwardly extending portion 214*b* and central portion 212 form a wedge type bend of substantially 45 degrees. Similarly, first upwardly extending portion 226*a* and first upwardly extending portion 226*b* form a wedge type bend of substantially 45 degrees with central portion 224.

The present embodiment provides a high load capacity while maintaining a low working friction when extending to full extension. The trapezoidal shape of the components of slide assembly 200 provides a high load capacity by centering the load of inner slide component 210 at junctures 220*a* and 220*b*, such that the load causes no deformation of first upwardly extending portion 214*a* and first upwardly extending portion 214*b*. The load capacity is maximized where angles 222*a* and 222*b* are 135 degrees and where first upwardly extending portion 214*a* and first upwardly extending portion 214*b* form a wedge type bend of substantially 45 degrees with central portion 212. Likewise, centering the load of intermediate slide component 208 at the juncture of center portion 224 and first upwardly extending portion 226*a* and the juncture of center portion 224 and second upwardly extending portion 226*b* causes no deformation of first upwardly extending portion 226*a* and first upwardly extending portion 226*b*, thereby increasing the load capacity of slide assembly 200.

The low operational friction is achieved by utilizing the trapezoidal profile limiting the components to tangential contact with each other. Almost line contact creates a low surface area of contact, thus lowering the operational friction. Specifically, the physical contact of second outer slide component 206 with intermediate slide component 208 and the physical contact of intermediate slide component 208 with inner slide component 210 is tangential, minimizing the surface area of contact.

It should be appreciated that the slide assembly of the present invention has a low profile such that it can fit in smaller sized gaps between the rack and the chassis. However, in certain situation, the slide assembly of the present invention is required to fit within larger sized gaps. To accommodate this need for flexibility in width of the slide assembly, in one embodiment, the present invention implements indentations in the outer slide components.

Figure 5A:
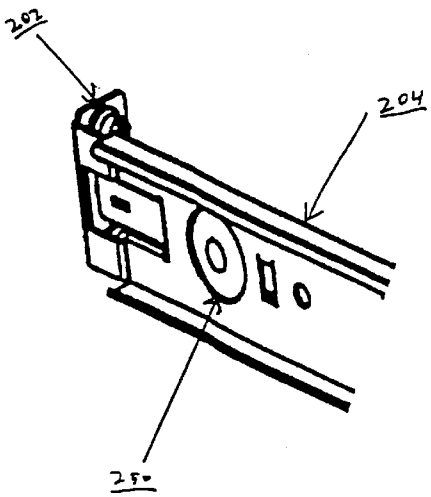
FIG. 5A shows an expanded perspective cut-away view of a portion of the slide assembly of FIG. 3 having an indentation in accordance with one embodiment of the present invention.

FIG. 5A shows an expanded perspective cut-away view of a portion of slide assembly 200 of FIG. 3 having an indentation 250 in an outer slide component in accordance with one embodiment of the present invention. In one embodiment, indentation 250 resides within first outer slide component 204. In another embodiment, indentation 250 resides within second outer slide component 206. In one embodiment, indentation 250 is fabricated into first outer slide component 204. In another embodiment, indentation 250 is pressed into first outer slide component 204.

Figure 5B:
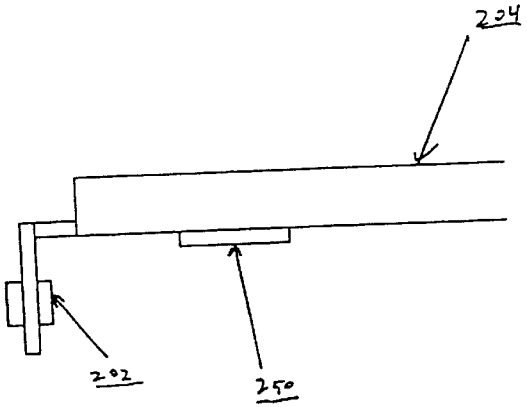
FIG. 5B shows an expanded top view of a portion of the slide assembly of FIG. 3 having an indentation in accordance with one embodiment of the present invention.

FIG. 5B shows an expanded top view of a portion of slide assembly 200 of FIG. 3 having an indentation 250 in accordance with one embodiment of the present invention. FIG. 5B illustrates that indentation 250 protrudes out from the mounting side of first outer slide component 204. It should be appreciated that indentation 250 has a predetermined width, thus providing two widths of slide assembly 200 (e.g., 10 mm and 12 mm).

In one embodiment, in rack assemblies where a low profile slide assembly is required, mounting flanges 202 are used to couple slide assembly 200 to a rack. It should be appreciated that if mounting flanges 202 are used to couple slide assembly 200 to a rack, indentations 250 will be placed within recesses within the rack, thus accounting for their width. Conversely, in another embodiment, in rack assemblies where a wider slide assembly is required, slide assembly 200 is mounted to a rack through indentation 250. It should be appreciated that both ends of an outer slide component can have indentations, thus allowing for coupling at both ends.

Figure 6A:
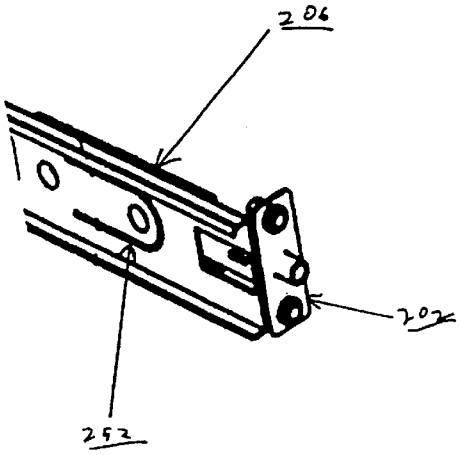
FIG. 6A shows an expanded perspective cut-away view of a portion of the slide assembly of FIG. 3 having a deformable tab in accordance with one embodiment of the present invention.

In another embodiment, the present invention implements deformable tabs in the outer slide components to accommodate for flexibility in width of the slide assembly. FIG. 6A shows an expanded perspective cut-away view of a portion of slide assembly 200 of FIG. 3 having a deformable tab 252 in an outer slide component in accordance with one embodiment of the present invention. In one embodiment, deformable tab 252 resides within first outer slide component 204. In one embodiment, deformable tab 252 is fabricated into first outer slide component 204. It should be appreciated that deformable tab 252 may reside within any outer slide component (e.g., first outer slide component 204 and second outer slide component 206).

Figure 6B:
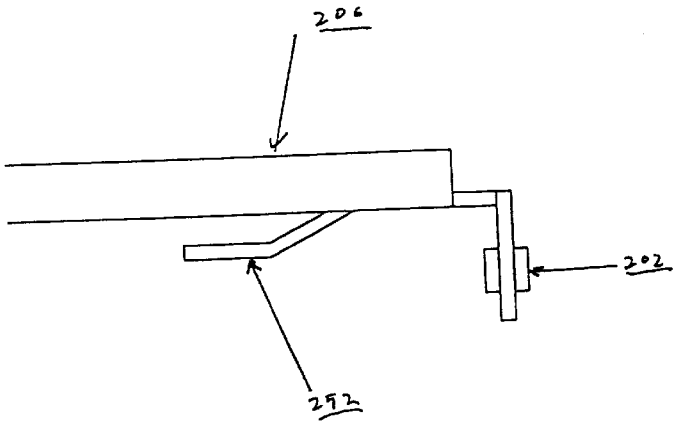
FIG. 6B shows an expanded top view of a portion of the slide assembly of FIG. 3 having a deformable tab in accordance with one embodiment of the present invention.

FIG. 6B shows an expanded top view of a portion of slide assembly 200 of FIG. 3 having a deformable tab 252 in accordance with one embodiment of the present invention. FIG. 6B illustrates that deformable tab 252 protrudes out from the mounting side of second outer slide component 206. It should be appreciated that deformable tab 252 has an adjustable width, thus providing for multiple widths of slide assembly 200.

In one embodiment, in rack assemblies where a low profile slide assembly is required, mounting flanges 202 are used to couple slide assembly 200 to a rack. It should be appreciated that if mounting flanges 202 are used to couple slide assembly 200 to a rack, deformable tab 252 is not deformed, and thus does not alter the width of slide assembly 200. Conversely, in another embodiment, in rack assemblies where a wider slide assembly is required, slide assembly 200 is mounted to a rack through deformable tab 252. It should be appreciated that both ends of an outer slide component can have deformable tabs, thus allowing for coupling at both ends.

The present invention provides indentations and deformable tabs for use in slide assemblies in order to account for varying gap widths of racks by ensuring that the slide assembly has an equal width. It should be appreciated that a slide assembly may have any combination of indentations and deformable tabs, and are not limited to the described embodiments. In one embodiment, an outer slide assembly comprises two indentations, one located at each end. In another embodiment, an outer slide assembly comprises two deformable tabs, one located at each end. In another embodiment, an outer slide assembly comprises an indentation located at one end and a deformable tab located at the other end.

Figure 7:
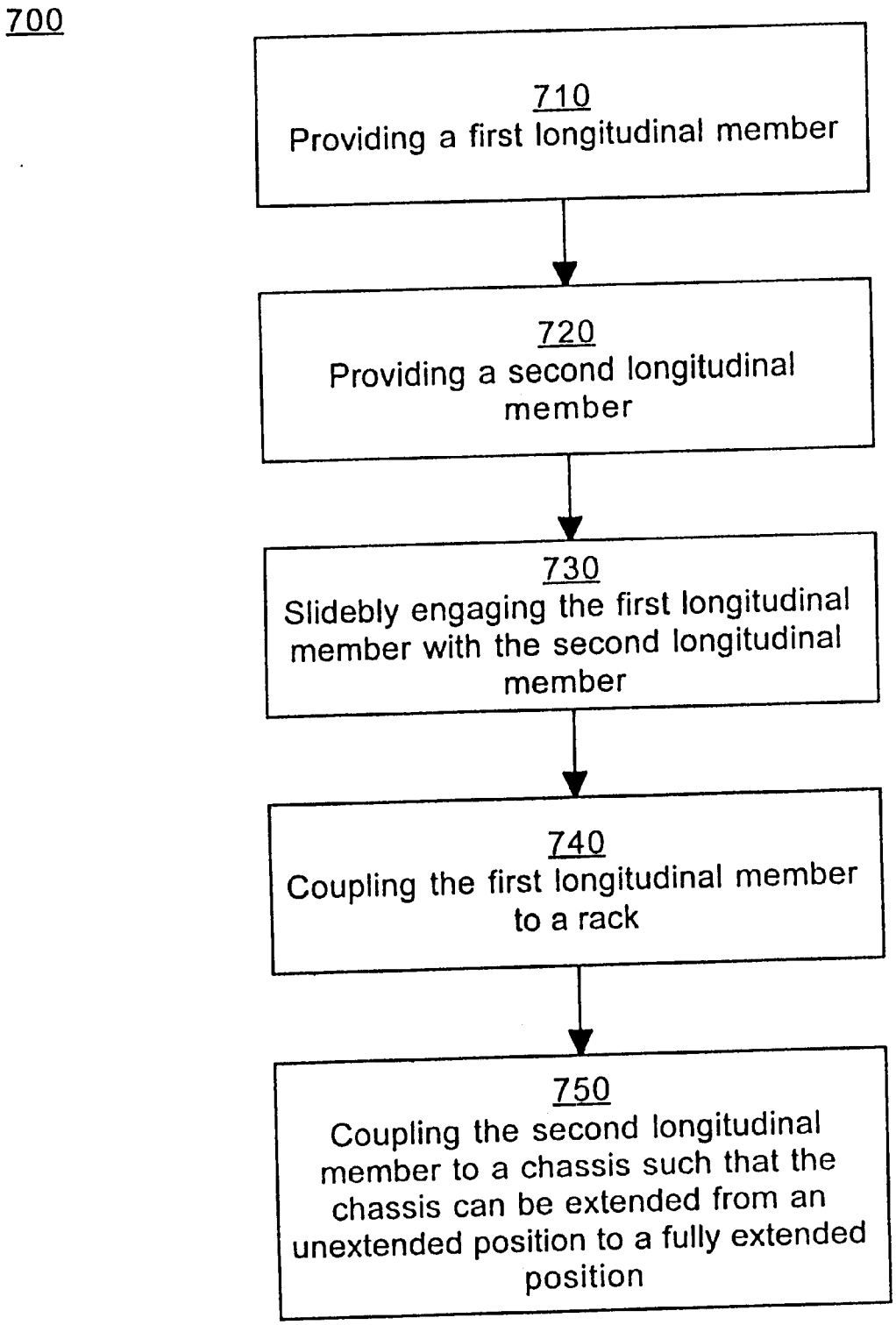
FIG. 7 Illustrates the steps in a process for slidably coupling a first longitudinal member to a second longitudinal member in accordance with one embodiment of the present invention.

FIG. 7 illustrates the steps in a process 700 for slidably coupling a first longitudinal member to a second longitudinal member in accordance with one embodiment of the present invention.

At step 710, a first longitudinal member is provided, wherein the first longitudinal member has a central portion, a first upwardly extending portion on a first side and a second upwardly extending portion on a second side.

At step 720, a second longitudinal member is provided, wherein the second longitudinal member has a central portion, a first downwardly extending portion on a first side and a second downwardly extending portion on a second side.

At step 730, the first longitudinal member is slidably engaged with the second longitudinal member such that the first downwardly extending portion engages the first longitudinal member proximate a juncture between the first upwardly extending portion and the central portion of the first longitudinal member and such that the second downwardly extending portion engages the first longitudinal member proximate a juncture between the second upwardly extending portion and the central portion of the first longitudinal member. The engagement of the first longitudinal member and the second longitudinal member allows the second longitudinal member to slide lengthwise with respect to the first longitudinal member.

In one embodiment, shown at step 740, the first longitudinal member is coupled to a rack (e.g., rack 105 of FIGS. 1A and 1B). In one embodiment, the first longitudinal member is coupled to the rack using mounting flanges at each end of the first longitudinal member. In another embodiment, the first longitudinal member is coupled to the rack using indentations proximate each end of the first longitudinal member. In another embodiment, the first longitudinal member is coupled to the rack using deformable tabs proximate each end of the first longitudinal member.

In one embodiment, shown at step 750, the second longitudinal member is coupled to a chassis for receiving a computer-related component, such that the chassis can be extended from an unextended position to a fully extended position relative to the rack.

In summary, the method and apparatus of the present invention provides a low profile slide assembly that can be used irrespective of the gap between the chassis equipment and the inner side of rack assembly. Moreover, the method and apparatus of the present invention also provides a slide assembly that can carry a higher load when fully extended. Furthermore, the method and apparatus of the present invention also provides a slide assembly that has a low friction component, requiring less force to extend the slide assembly.

The preferred embodiment of the present invention, a high load capacity, low profile, low friction slide assembly for use in a rack mount, is thus described. While the present invention has been described in particular embodiments, it should be appreciated that the present invention should not be construed as limited by such embodiments, but rather construed according to the below claims.

What is claimed is:

1. A low-profile enhanced load capacity slide assembly with reduced sliding friction, said slide assembly comprising:

an outer slide component configured in a low-profile orientation providing enhanced load capacity and configured to be fixedly attached to a rack assembly;

an intermediate slide component configured in a low-profile orientation providing enhanced load capacity and configured to be slidably engaged with said outer slide component such that said intermediate slide component can slide lengthwise with respect to said outer slide component; and an inner slide component configured in a low-profile orientation providing enhanced load capacity and configured to be slidably engaged with said intermediate slide component such that said inner slide component can slide lengthwise with respect to said intermediate slide component and wherein said inner slide component makes tangential contact with said intermediate slide component providing reduced sliding friction.

2. The slide assembly as recited at claim 1 wherein said outer slide component comprises a central portion, a first upwardly extending portion on a first side and a second upwardly extending portion on a second side;

wherein said intermediate slide component comprises a central portion, a first upwardly extending portion on a first side and a second upwardly extending portion on a second side; and wherein said inner slide component comprises a central portion, a first downwardly extending portion on a first side and a second downwardly extending portion on a second side.

3. The slide assembly as recited in claim 2 wherein said inner slide component is slidably engaged with said intermediate slide component such that said first downwardly extending portion of engages said intermediate slide component proximate a juncture between said first upwardly extending portion and said central portion of said outer slide component and said second downwardly extending portion engages said intermediate slide component proximate a juncture between said second upwardly extending portion and said central portion of said intermediate slide component.

4. The slide assembly as recited in claim 2 wherein said first downwardly extending portion and said second downwardly extending portion extend symmetrically from said central portion of said inner slide component.

5. The slide assembly as recited in claim 2 wherein said first downwardly extending portion and said central portion of said inner slide component form a cross-sectional angle of substantially 135 degrees and wherein said second downwardly extending portion and said central portion of said inner slide component form a cross-sectional angle of substantially 135 degrees.

6. The slide assembly as recited in claim 1 wherein said outer slide component comprises a deformable tab for adjusting the width of said slide assembly.

7. The slide assembly as recited in claim 1 wherein said outer slide component member comprises an indentation.

8. The slide assembly as recited in claim 1 having a low-profile width of ten millimeters.

9. The slide assembly as recited in claim 1 wherein said outer slide component, said intermediate slide component, and said inner slide component have trapezoidal profiles.

10. A rack assembly comprising:

a rack;

at least one low-profile enhanced load capacity slide assembly with reduced sliding friction coupled to said rack, wherein said slide assembly comprises:

an outer slide component configured in a low-profile orientation providing enhanced load capacity and configured to be fixedly attached to a rack assembly;

an intermediate slide component configured in a low-profile orientation providing enhanced load capacity and configured to be slidably engaged with said outer slide component such that said intermediate slide component can slide lengthwise with respect to said outer slide component; and an inner slide component configured in a low-profile orientation providing enhanced load capacity and configured to be slidably engaged with said intermediate slide component such that said inner slide component can slide lengthwise with respect to said intermediate slide component and wherein said inner slide. component makes tangential contact with said intermediate slide component providing reduced sliding friction; and a chassis for receiving a computer-related component, said chassis coupled to said inner slide component such that said chassis can be extended from an unextended position to a fully extended position with respect to said rack assembly.

11. The rack assembly as recited at claim 10 wherein said outer slide component comprises a central portion, a first upwardly extending portion on a first side and a second upwardly extending portion on a second side, wherein said intermediate slide component comprises a central portion, a first upwardly extending portion on a first side and a second upwardly extending portion on a second side; and wherein said inner slide component comprises a central portion, a first downwardly extending portion on a first side and a second downwardly extending portion on a second side.

12. The rack assembly as recited in claim 11 wherein said inner slide component is slidably engaged with said intermediate slide component such that said first downwardly extending portion of engages said intermediate slide component proximate a juncture between said first upwardly extending portion and said central portion of said outer slide component and said second downwardly extending portion engages said intermediate slide component proximate a juncture between said second upwardly extending portion and said central portion of said intermediate slide component.

13. The rack assembly as recited in claim 11 wherein said first downwardly extending portion and said second downwardly extending portion extend symmetrically from said central portion of said inner slide component.

14. The rack assembly as recited in claim 11 wherein said first downwardly extending portion and said central portion of said inner slide component form a cross-sectional angle of substantially 135 degrees and wherein said second downwardly extending portion and said central portion of said inner slide component form a cross-sectional angle of substantially 135 degrees.

15. The rack assembly as recited in claim 10 wherein said outer slide component comprises a deformable tab for adjusting the width of said slide assembly.

16. The rack assembly as recited in claim 10 wherein said outer slide component member comprises an indentation.

17. The rack assembly as recited in claim 10 wherein said slide assembly has a low-profile width of ten millimeters.

18. The rack assembly as recited in claim 10 wherein said outer slide component, said intermediate slide component, and said inner slide component have trapezoidal profiles.

19. A method of achieving a low-profile enhanced load capacity slide assembly with reduced sliding friction, said method comprising:

providing an outer slide component configured in a low-profile orientation providing enhanced load capacity and configured to be fixedly attached to a rack assembly;

providing an intermediate slide component configured in a low-profile orientation providing enhanced load capacity and configured to be slidably engaged with said outer slide component such that said intermediate slide component can slide lengthwise with respect to said outer slide component; and providing an inner slide component configured in a low-profile orientation providing enhanced load capacity and configured to be slidably engaged with said intermediate slide component such that said inner slide component can slide lengthwise with respect to said intermediate slide component and wherein said inner slide component makes tangential contact with said intermediate slide component providing reduced sliding friction.

20. The method as recited at claim 19 wherein said outer slide component comprises a central portion, a first upwardly extending portion on a first side and a second upwardly extending portion on a second side, wherein said intermediate slide component comprises a central portion, a first upwardly extending portion on a first side and a second upwardly extending portion on a second side, and wherein said inner slide component comprises a central portion, a first downwardly extending portion on a first side and a second downwardly extending portion on a second side.

21. The method as recited in claim 20 further comprising slidably engaging said inner slide component with said intermediate slide component such that said first downwardly extending portion of engages said intermediate slide component proximate a juncture between said first upwardly extending portion and said central portion of said outer slide component and said second downwardly extending portion engages said intermediate slide component proximate a juncture between said second upwardly extending portion and said central portion of said intermediate slide component.

22. The method as recited in claim 19 wherein said slide assembly has a low-profile width of ten millimeters.

23. The method as recited in claim 19 wherein said outer slide component, said intermediate slide component, and said inner slide component have trapezoidal profiles.

* * * * *